US005316384A

United States Patent [19]

Corso

[11] Patent Number: 5,316,384

[45] Date of Patent: May 31, 1994

[54] PRIMARY-SECONDARY CIRCUIT HYDRAULIC INTERFACE

[75] Inventor: Anthony B. Corso, Cincinnati, Ohio

[73] Assignee: Unosource Controls, Inc., Cincinnati, Ohio

[21] Appl. No.: 976,262

[22] Filed: Nov. 13, 1992

[51] Int. Cl.[5] ..... B01F 5/00

[52] U.S. Cl. ..... 366/338; 137/896; 366/341

[58] Field of Search ..... 366/340, 336, 341, 338; 454/261; 137/896

[56] References Cited

U.S. PATENT DOCUMENTS 3,920,552 11/1975 Elkern ..... 366/340

4,647,212 3/1987 Hankison ..... 366/340

*Primary Examiner*—William E. Wayner

*Attorney, Agent, or Firm*—Frost & Jacobs

[57] ABSTRACT

A primary-secondary circuit hydraulic interface is disclosed for use in chilled water and hot water systems in which a suction manifold header is used to tie in the secondary return water, the primary supply water, and the suction side of the primary and secondary pumps. The hydraulic interface is installed within the suction manifold at the location where the secondary return water enters the suction manifold. The hydraulic interface allows the bypass water (which is excess primary supply water) and the secondary return water to easily enter the hydraulic interface into a downstream portion of the manifold through large openings and forces the two streams of water to collide together, thereby ensuring a turbulent mixing to take place. The hydraulic interface forces the mixed water to exit the hydraulic interface through much smaller openings into a downstream portion of the manifold, thereby ensuring that the bypass water and secondary return water are thoroughly blended together as they exit. The temperature profile of the blended water is substantially uniform across the pipe diameter of the manifold as the water exits the hydraulic interface.

10 Claims, 6 Drawing Sheets

Top View (section)

Inlet View

Side View

Outlet View

PRIMARY-SECONDARY CIRCUIT HYDRAULIC INTERFACE

TECHNICAL FIELD

The present invention relates generally to chilled water and hot water equipment and is particularly directed to the interface between the primary and secondary chilled or hot water circuits of the type which utilize a suction manifold which allows some of the water to be bypassed. The invention will be specifically disclosed in connection with a hydraulic interface which blends the bypass water with returning secondary chilled or hot water to create a nearly uniform temperature profile across the diameter of the pipe at all load operating conditions which leads into the primary chilled water or hot water pumps.

BACKGROUND OF THE INVENTION

Chilled water systems typically use a primary pump per chiller to pump returning water through the chiller at a relatively low pressure. The returning water is typically at a temperature of about 55° F. (12.8° C.), and its temperature is lowered by the chiller to about 45° F. F (7.2° C.) as it exits the chiller. The primary chilled water pump provides a constant flow and pressure which is matched to the requirements and capacities of the chiller. For example, the primary chilled water pump could produce a flow $Q_1$ at a pressure H, which satisfies the requirements of its associated chiller, and which, in turn, produces the same flow $Q_1$ at the chiller's outlet. If the system includes two chillers which are both on-line simultaneously, the total primary chilled water supply flow would be $2Q_1$.

The primary chilled water system supplies chilled water to a secondary chilled water system in most installations. A secondary chilled water system has larger pumps which pump the chilled water at a much higher pressure to valves and cooling coils, which make up the load of the chilled water system. If, for example, the chilled water system is designed to cool a high-rise office building, then the secondary chilled water pumps must be able to produce a sufficient pressure $H_2$ to pump the water to all required locations of that high-rise building.

In some existing chilled water system designs, constant speed pumps have been used for the chilled water pumps. In such systems, if one chiller and one primary chilled water pump are on-line, for example, producing a flow $Q_1$, then typically one secondary chilled water pump is also running which supplies the system's required flow. If the primary chilled water pumps and the secondary chilled water pumps are not pumping at the same flow rate, which is often the case, then a bypass line must be installed so that excess primary chilled water can flow back into the suction side of the primary chilled water pumps without being circulated throughout the secondary chilled water system. This would occur, of course, in situations where the primary chilled water pump was pumping a flow rate $Q_1$, which was greater than the flow rate $Q_2$ then being pumped by the secondary chilled water pump. If, on the other hand, the secondary chilled water pump(s) was pumping at a flow rate $Q_3$, which was greater than $Q_2$, then the same bypass line would circulate excess secondary chilled water from the secondary chilled water system return line back into the suction side of the secondary chilled water pump(s).

Many of the systems installed over the last 10–15 years have used variable speed pumps for secondary chilled water pumps. The variable speed secondary chilled water pump allows the overall chilled water system to automatically and efficiently compensate for a varying cooling load by supplying only the required amount of chilled water flow and head (pressure) to satisfy the system demand. The secondary chilled water pumps are sized so that they can provide sufficient chilled water for a maximum cooling demand condition, with the secondary chilled water pumps are running at their maximum speeds. When the system cooling demand is less than maximum, then the secondary chilled water pumps can run at a reduced speed, thereby saving electrical energy.

Since, in such systems, the primary chilled water pumps are constant speed pumps sized to match up with their particular chillers, and the secondary chilled water pumps are variable speed pumps, there typically will be a miss-match between the primary chilled water flow and the secondary chilled water flow required to satisfy the system load. Since it is easier to run a variable speed secondary chilled water pump at a reduced speed than it is to start and stop extra chillers, the primary chilled water system will typically produce more water flow than is required for the secondary chilled water system's needs. That being the case, the bypass line will typically recirculate primary chilled water.

Many of the chilled water systems available at the present time include a package pumping system, in which the primary chilled water pumps and the secondary chilled water pumps are all mounted to a common mounting base. In such systems, it is common to include a suction manifold which receives water from the chillers (primary chilled water supply), and water from the system cooling coils (secondary chilled water return). This water is then directed into the suction side of the various secondary chilled water and primary chilled water pumps. The location where the secondary chilled water return connects into the suction manifold is usually in the form of a "T"-type intersection, in which bypass water (typically excess primary chilled water) collides with the returning secondary chilled water. The combination of bypass water and return secondary chilled water is then directed into the suction side of the primary chilled water pumps.

A major failing of such chilled water systems available at the present time is that the bypass water and the returned secondary chilled water are not blended together properly, thus producing a non-uniform temperature profile along the cross-section of the suction manifold pipe and, in situations where more than one primary chilled water pump is running, one or more of the primary chilled water pumps will receive warmer water at its suction side than the remaining primary chilled water pumps. The use of methods such as having a straight bypass run of at least ten pipe diameters at the bypass line does not solve this problem, because the extra length of straight pipe merely allows the flow of the bypass water to become less turbulent and more laminar. Having laminar flow bypass water does not help to blend that bypass water with the returning secondary chilled water. In fact, the opposite is true. The more turbulent the bypass and returning secondary chilled water, the greater the blending between the two waters to create a more uniform temperature profile along the cross-section of the suction manifold pipe feeding the primary chilled water pumps.

SUMMARY OF THE INVENTION

Accordingly, it is a primary object of the present invention to provide a primary-secondary chilled water circuit hydraulic interface which thoroughly blends the bypass water with the returning secondary chilled water, to create a substantially uniform temperature profile along the cross-section of the pipe feeding the primary chilled water pumps.

It is another object of the present invention to provide a primary-secondary circuit hydraulic interface which thoroughly blends the bypass water and the returning secondary chilled water under varying flow, pressure, and temperature conditions.

It is a further object of the present invention to provide a primary-secondary circuit hydraulic interface which is simple in construction and occupies only a small footprint of area.

It is yet another object of the present invention to provide a primary-secondary hot water circuit hydraulic interface which can blend bypass water with returning secondary hot water in a hot water system, to create a substantially uniform temperature profile along the cross-section of the pipe feeding the primary hot water pumps.

It is yet a further object of the present invention to provide a primary-secondary circuit hydraulic interface which thoroughly blends the bypass water and the returning secondary hot water under varying flow, pressure, and temperature conditions.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved primary-secondary circuit hydraulic interface is provided which can blend bypass water with returning secondary water such that a substantially uniform temperature profile is created along the cross-section of the pipe feeding the primary pumps. The hydraulic interface has no moving parts and is of rather simple construction. The hydraulic interface is formed of a hollow cylinder, which has an opening at its top to receive returning secondary water, a second opening in its side to receive bypass water, and a large number of small openings which allow the incoming water to exit from the hollow cylinder. The bypass water and returning secondary water are mixed together under turbulent conditions within the hollow cylinder of the hydraulic interface, thereby blending the two waters quite thoroughly. As the blended water is forced out of the smaller openings, a substantially uniform temperature profile is created along the cross-section of that portion of the pipe which is further downstream from the hydraulic interface, and which feeds the primary pumps. In this manner, each of the primary pumps are fed blended water having nearly equal temperatures.

The hydraulic interface can work with both chilled water systems and hot water systems. The hydraulic interface works at substantially the same efficiency under varying flow, pressure, and temperature conditions, which is possible by the lack of moving parts within the structure of the hydraulic interface. The efficiency of the hydraulic interface is quite good due to the low pressure drop in the water passing through the hydraulic interface.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawing and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
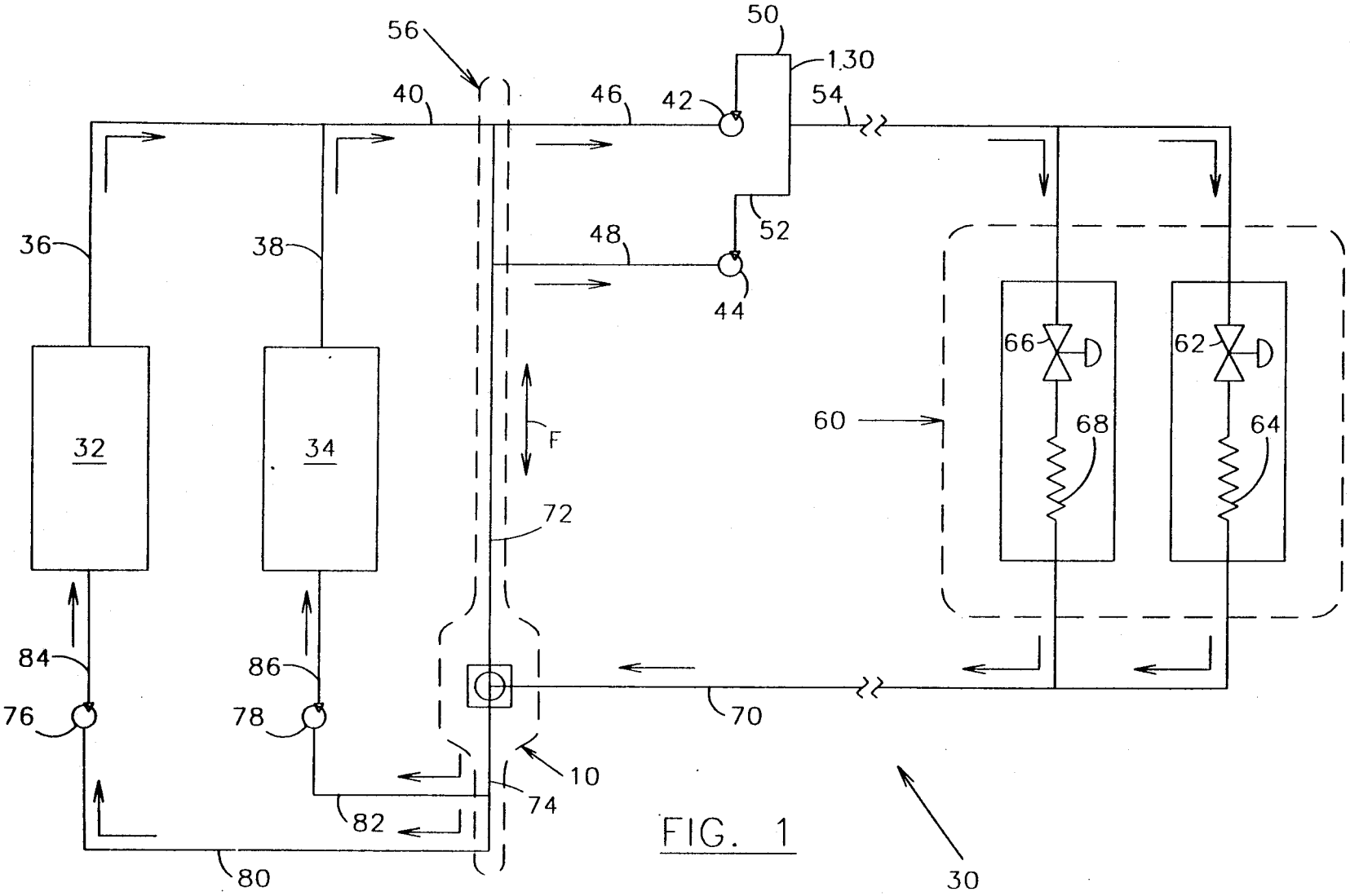
FIG. 1 is a schematic hydraulic diagram of a chilled water system having a primary chilled water circuit consisting of two chillers and two primary pumps, a secondary chilled water system comprising two secondary pumps and two system loads, and a bypass circuit.

Referring now to the drawings, FIG. 1 schematically depicts a typical chilled water system (generally indicated at 30) having two chillers 32 and 34, two primary chilled water pumps 76 and 78, two secondary chilled water pumps 42 and 44, a secondary chilled water system load (generally indicated at 60), a bypass line 72, and a hydraulic interface 10. Beginning with the primary system, the first primary chilled water pump 76 pumps water through an inlet pipe 84 into first chiller 32. Similarly, second primary chilled water pump 78 pumps water through inlet pipe 86 into second chiller 34. In a system having two chillers, it is typical for each chiller to be of the same capacity, and their primary pumps would similarly be of the same capacity. In FIG. 1, the first primary chilled water pump 76 is a constant speed pump having a flow capacity of $Q_1$. The second primary chilled water pump 78 is also a constant speed pump and has a similar flow capacity $Q_1$.

After being cooled, chilled water exits the first chiller 32 through outlet pipe 36. In a similar fashion, chilled water exits the second chiller 34 through outlet pipe 38. The direction of the water flow is given by arrows in the diagram of FIG. 1. Outlet pipes 36 and 38 join together to form an outlet header 40, through which the primary chilled water supply flows. If only one chiller is operating, the flow rate through outlet header 40 is equal to $Q_1$. If both chillers are operating simultaneously, then the flow rate through outlet header 40 is equal to $2Q_1$.

It will be understood that primary pumps 76 and 78 could be located on the outlet side of chillers 32 and 34, rather than on the inlet side of those same chillers (as shown in FIG. 1). If the primary pumps are located on the outlet side of the chillers, the overall chilled water system operation is not affected in any substantial way.

At this point, the supply primary chilled water enters the suction manifold 56, which will be described in greater detail below. Generally speaking, most of the supply primary chilled water will enter the secondary chilled water pump suction pipes 46 and 48. Suction pipe 46 feeds into the first secondary chilled water pump 42, and suction pipe 48 feeds into the second secondary chilled water pump 44. Secondary chilled water pumps 42 and 44 are variable speed pumps, each having a maximum flow capacity of $Q_1$ when running at their maximum speed. Secondary chilled water pumps 42 and 44 are also capable of producing a sufficient discharge pressure head to overcome the friction losses of the piping of the secondary chilled water system, and the cooling coil losses of the system load 60.

The first secondary chilled water pump 42 discharges water through its discharge pipe 50, into the secondary chilled water discharge header 130, and finally into a pipe 54 which is the secondary chilled water supply. In a similar fashion, the second secondary chilled water pump 44 discharges water through discharge pipe 52, into the secondary chilled water discharge header 130, and into the secondary chilled water supply 54.

The secondary chilled water supply is directed into the system load 60, which consists, in the hydraulic circuit of FIG. 1, of a pair of valves and cooling coils. Some of the secondary chilled water supply flows through a first valve 62 and into a first cooling coil 64. The remaining secondary chilled water supply flows through a second valve 66 and through a second cooling coil 68. After flowing through the cooling coils, the chilled water has now been raised in temperature to approximately 55° F. (12.8° C.). At this point, the chilled water is returned through a common return pipe 70 toward the suction manifold 56.

Secondary chilled water return pipe 70 directs water through hydraulic interface 10 and into the suction manifold 56. Temporarily ignoring the bypass line 72, the returned water from the secondary chilled water system then flows into a primary chilled water return pipe 74, which further directs the water into individual suction pipes 80 and 82. Suction pipe 80 returns water to the first primary chilled water pump 76, and suction pipe 82 returns water to the second primary chilled water pump 78.

The loop has now been completed and the chilled water will hence be cooled within the chillers 32 and 34 down to a temperature level of about 45° F. (7.2° C.). The above description assumed that there was no water flowing through the bypass line 72, a situation which would only rarely occur. If one chiller was operating at a flow of $Q_1$, and the system and cooling load was such that one of the secondary chilled water pumps was running at its maximum speed and flow capacity $Q_1$, than the flow through bypass line 72, designated by the letter "F", would be zero. In other words, the supply primary chilled water flow running through pipe 40 would be equal to $Q_1$, the supply secondary chilled water running through pipe 54 would also equal $Q_1$, the return secondary chilled water running through pipe 70 would be $Q_1$, and the return primary chilled water running through pipe 74 would also equal $Q_1$.

Since the secondary chilled water pumps 42 and 44 are variable speed pumps, they can run at speeds other than their maximum speed, thereby each producing a flow capacity less than $Q_1$. In situations where a secondary chilled water pump 42 or 44 is running other than at its maximum speed, then its output will be a flow rate $Q_2$ which is less than $Q_1$. In that situation, the bypass flow, designated by the letter F, would be equal to $Q_1$-$Q_2$, and the direction of the flow through bypass line 72 would be from top to bottom in FIG. 1. This is the normal case, for the variable speed secondary chilled water pumps 42 and 44 are designed to operate in just this manner.

On the other hand, if only one of the chillers 32 or 34 is operating, thereby producing a supply primary chilled water flow $Q_1$, and if both secondary chilled water pumps 42 and 44 are operating at a combined flow of $Q_3$ (which is greater than $Q_1$) at the secondary chilled water supply pipe 54, then the direction of the bypass line flow F would be from bottom toward the top in FIG. 1. In other words, some of the secondary chilled water would be recirculating, rather than some of the primary chilled water being recirculated as in the previous example. This, however, is not the normal operating mode of a chilled water system, for it is inefficient to run two secondary chilled water pumps at a reduced speed and flow rate as compared to running just one of those secondary chilled water pumps at full speed and flow rate. Therefore, the remaining portion of this disclosure will concentrate on the case where the secondary chilled water flow $Q_2$ is less than the primary chilled water flow $Q_1$, thereby recirculating a portion of the primary chilled water, and producing a flow F through bypass line 72 which is in the direction of top to bottom on FIG. 1.

Figure 2:
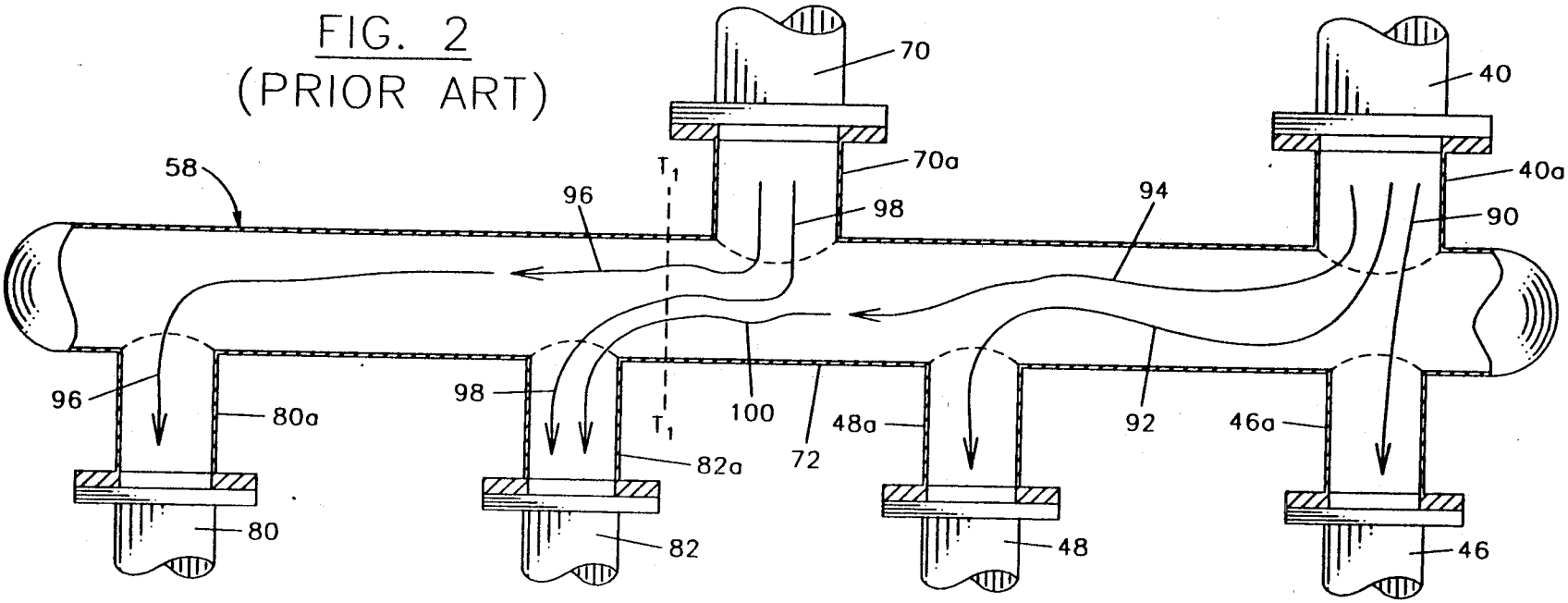
FIG. 2 (PRIOR ART)
FIG. 2 is a partial cross-section elevational view of the details of the suction manifold known in the prior art, and includes fluid flow path indications.

FIG. 2 depicts a suction manifold 58 which is known in the prior art, and is commonly used in chilled water systems having a primary and a secondary circuit. As depicted in FIG. 2, supply primary chilled water from the chillers 32 and 34, and outlet header 40 enters suction manifold 58 through its inlet 40*a*. Following the water path designated by the arrow 90, it can be seen that some of the supply primary chilled water exits the suction manifold 58 via its outlet 46*a* and enters suction pipe 46, which leads to the first secondary chilled water pump 42. Following the water path designated by the arrow 92, it can be seen that some of the supply primary chilled water exits the suction manifold 58 via its outlet 48*a* and enters the suction pipe 48 which leads to the second secondary chilled water pump 44. Following the water path designated by the arrow 94, it can be seen that some of the supply primary chilled water enters that portion of manifold 58 constituting the bypass line 72.

Return water from the secondary chilled water system enters through the return pipe 70 into the inlet 70*a* of suction manifold 58. Some of the return secondary chilled water follows the path designated by the arrows 96 and exits manifold 56 via its outlet 80*a* and into the suction pipe 80 which leads to the first primary chilled water pump 76. Some of the return secondary chilled water follows the path designated by the arrow 98, which collides with bypass water, designated by the arrow 100. The collision of these two water flows tends to force the bypass water into outlet 82*a* and suction pipe 82 which leads to the second primary chilled water pump 44, thereby following the water path indicated by arrow 100. The collision also tends to force most of the return secondary chilled water along water flow path 96 into outlet 80*a* and the suction pipe 80. Some of the return secondary chilled water will flow along water flow path 98 into outlet 82*a* and suction pipe 82.

Figure 2A:
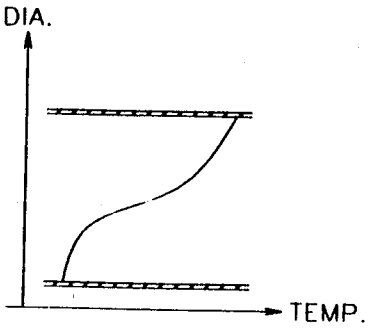
FIG. 2A is a chart showing the temperature profile of the water flowing through the cross-sectional area of the manifold at the diameter designated by the line $T_1$—$T_1$.

The overall effect of the collision of the water flow coming from the bypass line 72 with the water flow coming from the return secondary chilled water line 70 is a temperature profile given in FIG. 2A, which shows the temperature of the water across the diameter of the pipe along the line $T_1$—$T_1$. As can be seen in FIG. 2A, the cooler bypass water (at approximately 45° F. (7.2° C.)) tends to follow along the bottom portion of the suction manifold 58, and ultimately finds its way into the second primary chilled water pump 78 via suction pipe 82. On the other hand, the warmer return secondary chilled water (at approximately 55° F. (12.8° C.)) tends to be forced into the top portions of the suction manifold 58, and is mostly directed into the first primary chilled water pump 76 via suction pipe 80. This situation is undesirable, since at times when both chillers are operating simultaneously, first chiller 32 must work with return water that is much warmer than the return water entering second chiller 34. Chiller 32, thus, must work much harder than chiller 34.

As long as both chillers are operating simultaneously, the temperature imbalance situation will continue to exist, for there is no means for a more complete blending of the bypass water with the return secondary chilled water in the prior art system shown in FIG. 2. In fact, some installations have a relatively long straight run of pipe as part of the suction manifold 58, which tends to create laminar flow rather than turbulent flow. Laminar flow creates the opposite effect to that desired, because when the flow is laminar, the two water flows tend to not mix together very well, thereby enhancing the undesirable effect described above. A turbulent flow situation is much more desirable, for then the two water flows (the bypass water flow and the return secondary chilled water flow) will tend to at least mix together to a certain extent and become more blended, thereby more evenly balancing the temperature differential between the water entering the two chillers 32 and 34.

Figure 3D:
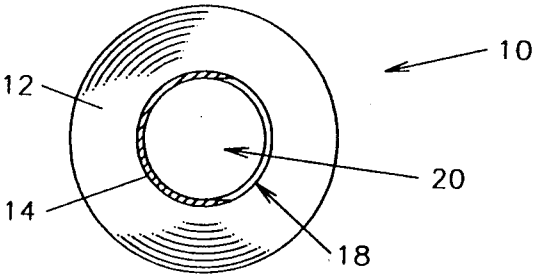
FIG. 3D is a sectional plan view of the hydraulic interface of FIG. 3B, taken along the line 1—1.
Figure 3C:
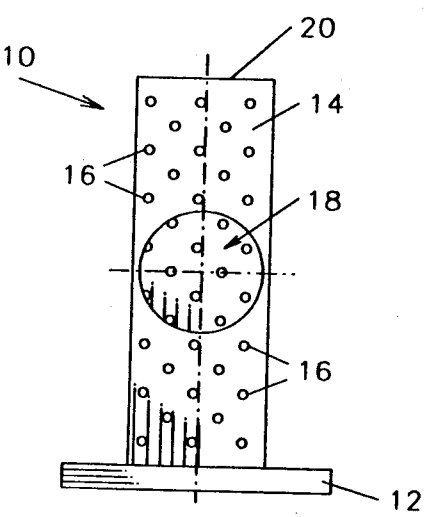
FIG. 3C is an elevational view of the hydraulic interface of FIG. 3A, as seen from an angle 180° from FIG. 3A.

The present invention teaches means for causing a thorough blending of the secondary return water with the portion of the primary supply water which is bypassed within the suction manifold. FIG. 3A shows a primary-secondary circuit hydraulic interface 10, having a mounting base plate 12 and a cylindrical portion 14. FIG. 3A shows the outlet portion of hydraulic interface 10 which contains a large number of small holes 16, which are arranged in a hole pattern at regular intervals, as shown by dimensions "A" and "B", which give the distances between the center lines of holes 16 in the horizontal and vertical directions, respectively.

Figure 3B:
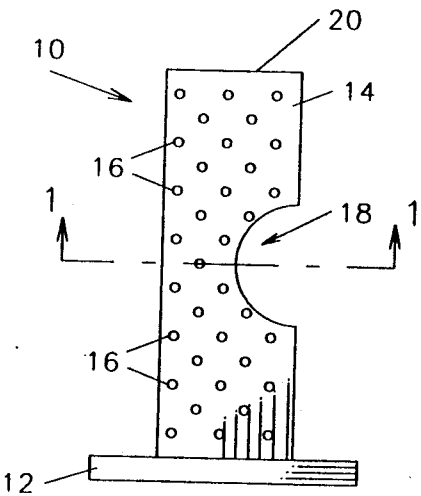
FIG. 3B is an elevational view of the hydraulic interface of FIG. 3A, as seen from an angle 90° from FIG. 3A.
Figure 3A:
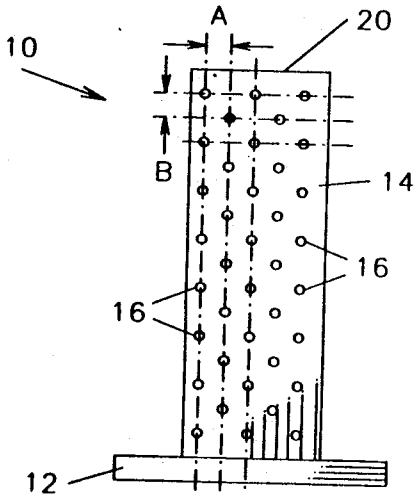
FIG. 3A is an elevational view of a hydraulic interface constructed in accordance with the principles of the present invention.

FIG. 3B shows hydraulic interface 10 from the side, wherein the small outlet holes 16 are visible as well as the large inlet opening 18. FIG. 3C shows hydraulic interface 10 from its inlet portion, and provides a better view of the large inlet opening 18.

FIG. 3D depicts hydraulic interface 10 from its top, in a cross-sectional view along the lines 1—1. As can be seen in FIG. 3D, the cylindrical portion 14 is hollow, and the large inlet opening 18 is clearly seen. The very top portion of cylindrical portion 14 is open, as designated by the numeral 20.

FIG. 3B can be used to help describe the directions of fluids passing into and out of hydraulic interface 10. Fluid (typically either hot water or chilled water) can enter hydraulic interface 10 from the right through the large inlet opening 18. Similarly, fluid can also enter hydraulic interface 10 from directly above through the large inlet opening 20. These two fluid paths will collide inside the cylindrical portion 14, and the fluids will remain within cylindrical portion 14 until the fluids pass through one of the small outlet holes 16. By the time the two fluids exit through one of the small outlet holes 16, they will have been thoroughly mixed together.

Figure 4:
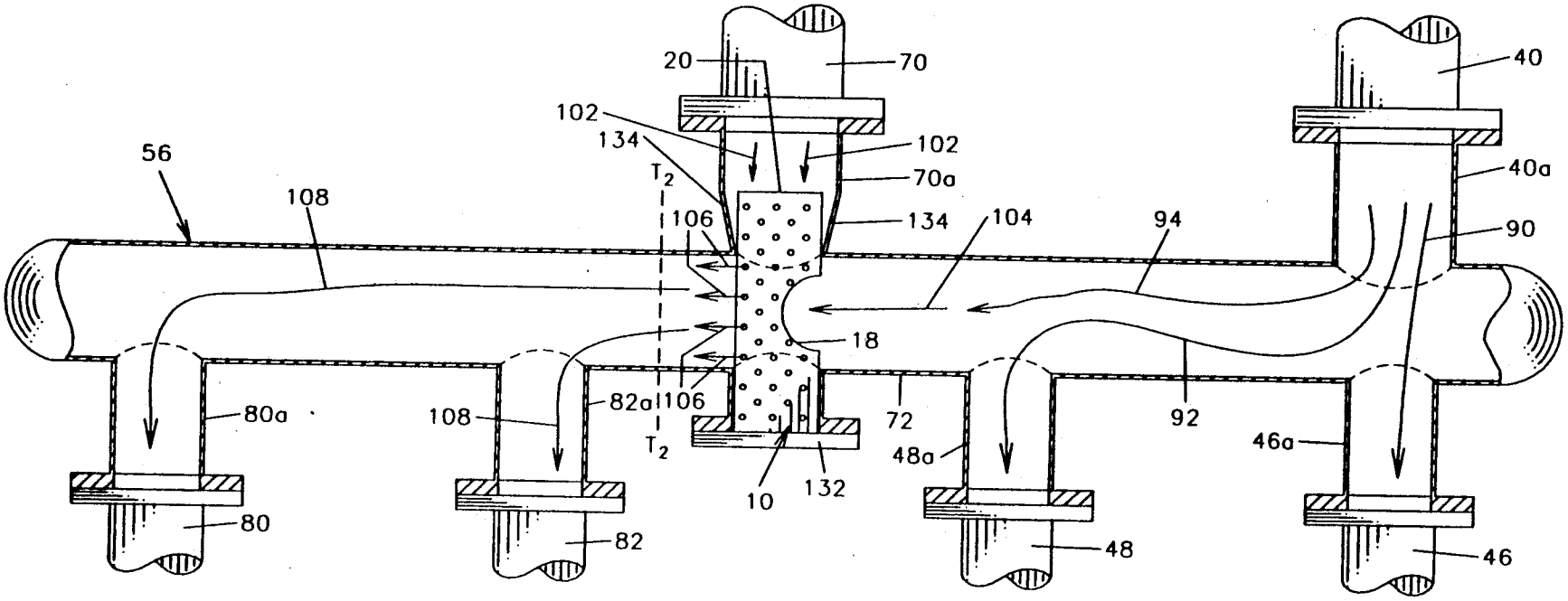
FIG. 4 is a partial cross-section elevational view of the details of the suction manifold known in the present invention, and includes fluid flow path indications.

By contrast with the prior art of FIG. 2, FIG. 4 depicts a suction manifold 56 which includes hydraulic interface 10. Suction manifold 56 is similar to suction manifold 58, and like parts have been given like index numerals. Supply primary chilled water from the chillers 32 and 34 enters inlet 40*a* of suction manifold 56 via the outlet header 40. As in the prior art, some of the supply primary chilled water will follow the water flow indicated by arrow 90 into suction pipe 46 (via outlet 46*a*) to the first secondary chilled water pump 42. Some of the supply primary chilled water will follow the water flow indicated by arrow 92 into suction pipe 48 via outlet 48*a* and on to the second secondary chilled water pump 44. Again, as in the prior art, some of the supplied primary chilled water will follow the water flow path indicated by arrow 94 into the bypass line 72. This supply primary chilled water has been cooled to approximately 45° F. (7.2° C.).

The return secondary chilled water enters the suction manifold 56 at inlet 70*a* connected to the pipe 70. At this point, the return secondary chilled water has been warmed to approximately 55° F. (12.8° C.). The return secondary chilled water enters the open top 20 of hydraulic interface 10, following the water path depicted by the arrows 102. The return secondary chilled water is further directed into the open top portion of hydraulic interface 10 by the inward taper of inlet 70 as indicated at 134. At the same time, bypass water enters the large inlet opening 18 in the side of hydraulic interface 10, by following the water path designated by the arrow 104. The large inlet openings 18 and 20 (see FIG. 3B) make it easy for the returned secondary chilled water and the supply primary chilled water to enter hydraulic interface 10, following water paths 102 and 104, respectively. Once the water is inside hydraulic interface 10, however, it must find its way through the small outlet holes 16 (see FIG. 3A) before it can exit hydraulic interface 10. The water will exit hydraulic interface 10 only after the two water columns have been blended together rather thoroughly. The water exits hydraulic interface 10 in a multitude of individual water paths designated by the arrows 106, and spreads out through the entire inner diameter of suction manifold 56 as it moves toward the primary chilled water pumps 76 and 78.

Figure 4A:
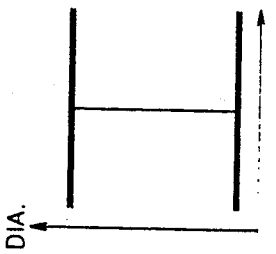
FIG. 4A is a chart showing the temperature profile of the water flowing through the cross-section area of the manifold at the diameter designated by the line $T_2$—$T_2$.

Since the water has been thoroughly blended, the temperature profile given in FIG. 4A is substantially uniform across the entire diameter of the suction manifold 56, taken along the diameter line $T_2$—$T_2$ of FIG. 4. Once the substantially uniform temperature profile has been established, it is of no consequence exactly how the water flows into the outlets 80*a* and 82*a* and suction pipes 80 and 82, which lead to the primary chilled water pumps 76 and 78. If both of the chillers are operating simultaneously, then approximately half of the water flowing past the temperature profile line $T_2$—$T_2$ will enter into each of the outlets 80*a* and 82*a* and the suction pipes 80 and 82, along the water paths designated by the arrows 108. Since the temperature is substantially equal for both water paths 108, then each chiller 32 and 34 will receive inlet water at the same temperature, thereby allowing each chiller 32 and 34 to work at approximately the same rate. This is the most desirable situation for the operation of chillers within the chilled water system 30. Since hydraulic interface 10 blends the two water flows so thoroughly, there is no requirement for a minimum or maximum number of pipe diameters of straight pipe in the bypass line portion of the suction manifold 56. Therefore, this hydraulic bridge between the primary and secondary chilled water systems can be as compact as can be physically constructed, and the determining package pump size restraints are the size of the pumps, motors, and other associated equipment, rather than minimum pipe diameter runs.

As can be seen in FIG. 4, a removal cap 132 is attached to the bottom of hydraulic interface 10. Removal cap 132 can be easily unbolted from the remainder of the suction manifold 56, thereby giving easy access to hydraulic interface 10. In addition, a drain (not shown) can be installed at the bottom removal cap 132. Such a drain is preferably a ¾" NPT hole, and would include a short ¾" pipe leading from that hole to a ball valve, which allows for easy debris blow down.

By studying FIG. 4, the preferred dimensions of hydraulic interface 10 can be best illustrated. If the pipe outer diameter of suction manifold 56 is designated by the letter "D", the overall (vertical) length of hydraulic interface 10 designated by the letter "L", and the outer diameter of cylinder 14 of hydraulic interface 10, designated by the letter "W", then the following preferred dimensions can be given in the form of equations:

$$L=2D \qquad \text{(Equation 1)}$$

$$(\tfrac{3}{4})D \geqq W \geqq (\tfrac{1}{2})D \qquad \text{(Equation 2)}$$

For example, if the suction manifold 56 pipe diameter (D) is 8", the overall height (L) of the hydraulic interface 10 would be 16", and the width (W) of hydraulic interface 10 would 5". In such an installation, the secondary chilled water return pipe 70 would also have an 8" diameter. In addition to the above specified dimensions, it is important to locate the center line of large inlet opening 18 at the center line of bypass line 72. This allows for the maximum amount of bypass water following the path 104 to easily enter hydraulic interface 10. By the same token, the center of the top portion 20 of hydraulic interface 10 should be at the same location as the center line of the return secondary chilled water pipe 70, so that the water following path 102 can most easily enter hydraulic interface 10.

In the above example, wherein D=8", L=16" and W=5", the small holes 16 would preferably have a diameter of ½". The small holes 16 would be preferably staggered and spaced apart along one inch center lines (see dimensions A and B in FIG. 3A). Using these dimensions and locations, the nearest distance from the center line of one of the small holes 16 to another would be approximately 1.414".

The preferred material of hydraulic interface 10 is schedule 40 black carbon steel, which is the same material as used in the chilled water system piping. In fact, hydraulic interface 10 can be mostly constructed of a section of schedule 40 pipe.

Figure 5:
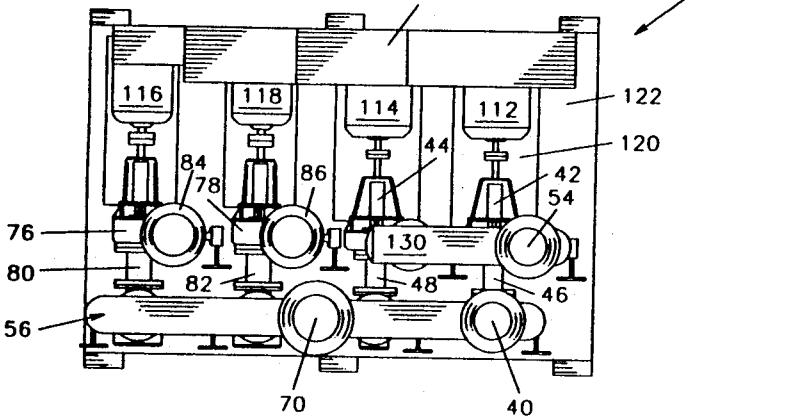
FIG. 5 is a plan view of a package pump assembly for the primary/secondary chilled water system built according to the principles of the present invention.
Figure 7:
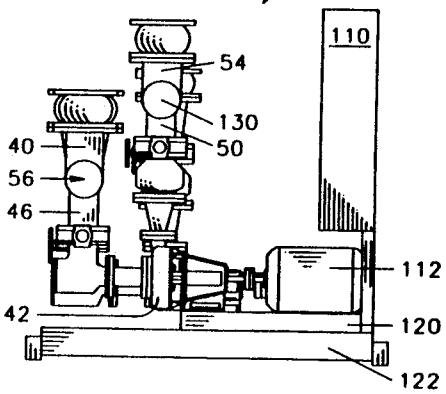
FIG. 7 is a side elevational view of the package pump assembly as seen from the right of FIG. 6.
Figure 6:
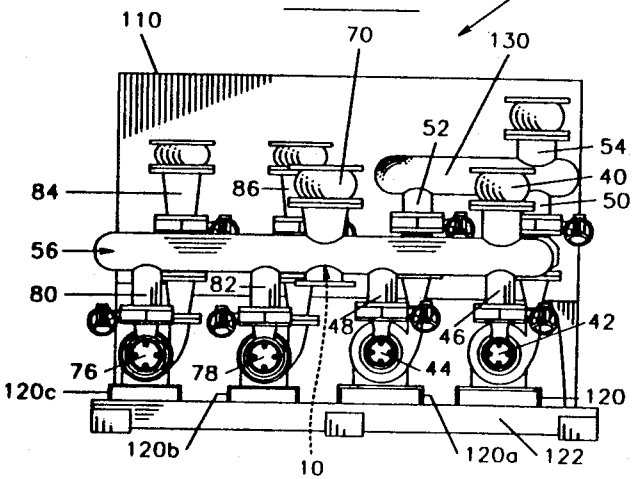
FIG. 6 is a front elevational view of the package pump assembly of FIG. 5.

FIGS. 5, 6, and 7 illustrate a practical package pumping system 140 usable in either a hot water or a chilled water system. Assuming the system depicted in these figures is a chilled water system, then the locations of the primary chilled water pumps 76 and 78, and the secondary chilled water pumps 42 and 44 can easily been seen in FIGS. 5 and 6. The associated motors for these pumps can also be seen in FIG. 5, wherein secondary chilled water pump 42 has a motor 112, secondary chilled water pump 44 has a motor 114, primary chilled water pump 76 has a motor 116, and primary chilled water pump 78 has a motor 118. The electrical control panel 110 is visible in all three figures, as is the base plate 122, which is in the form of a large skid. The mounting base for the first secondary chilled water pump 42 and its associated motor 112 is designated by the numeral 120. The other pump/motor assemblies have similar mounting bases 120*a*, 120*b*, and 120*c*.

The suction manifold 56 is visible in all three of FIGS. 5, 6, and 7, as is the secondary chilled water discharge header 130 (for the supply secondary chilled water). The hydraulic interface 10 is not visible at all in any of the these three figures. Its location can be most easily found at the junction of the return secondary chilled water pipe 70 and suction manifold 56, designated by the numeral 10 FIG. 6. As can be seen in FIG. 6, hydraulic interface 10 has a very small footprint, and virtually requires no extra space at all within the overall package pump assembly 140 of FIGS. 5, 6, and 7. The only visible effect of the installation of hydraulic interface 10 is a small vertical pipe run below suction manifold 56 at the junction of secondary chilled water return pipe 70 and suction manifold 56. This extra space is quite insignificant in the overall scheme of things, and would not be utilized for any other equipment regardless.

Figure 8:
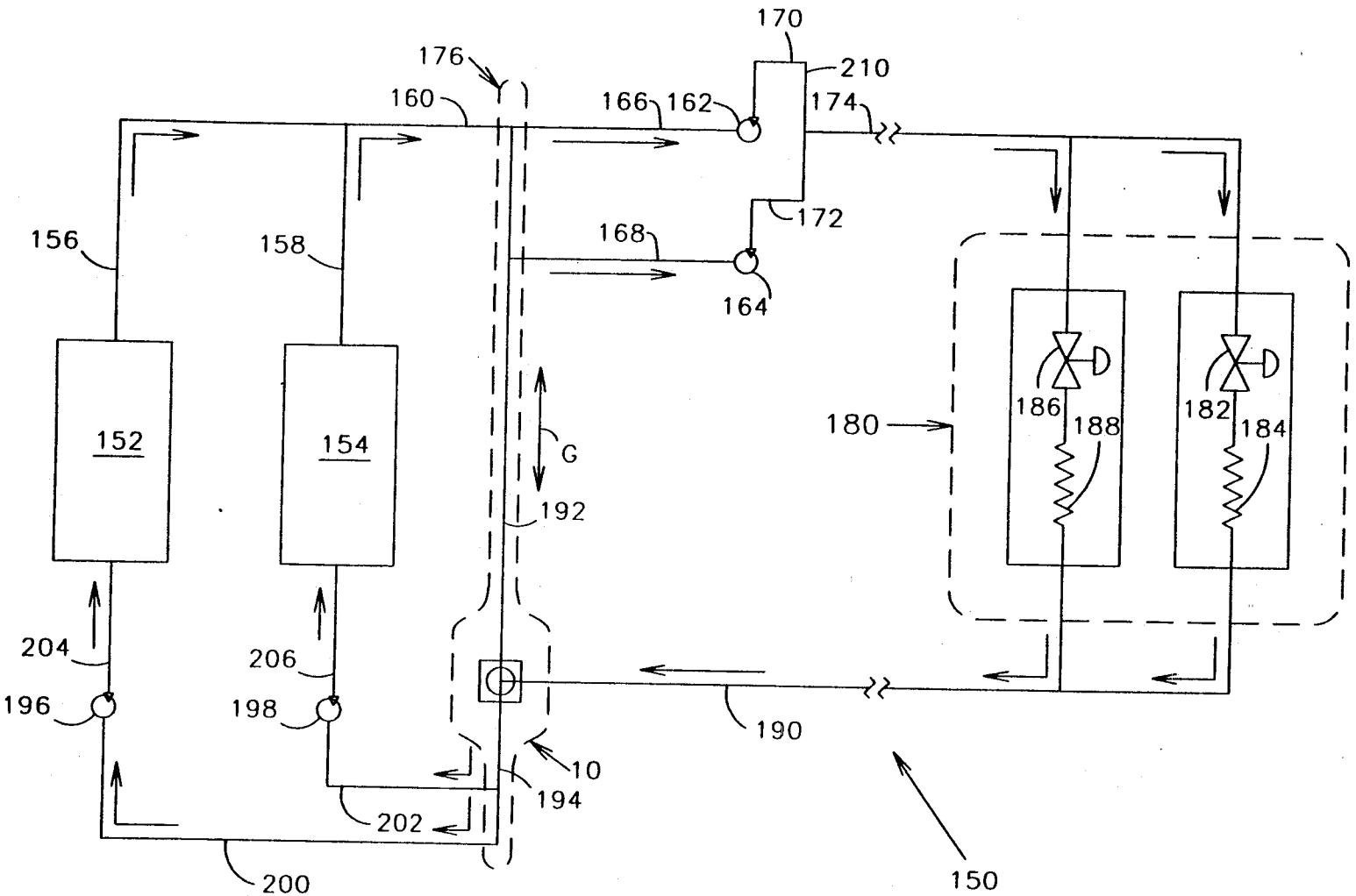
FIG. 8 is a schematic hydraulic diagram of a hot water system having a primary hot water circuit consisting of two boilers and two primary pumps, a secondary hot water system comprising two secondary pumps and two system loads, and a bypass circuit.

FIG. 8, depicts a typical hot water system, generally indicated at 150, and having two boilers 152 and 154 (or other sources of hot water, such as heat exchangers), two primary hot water pumps 196 and 198, two secondary hot water pumps 162 and 164, a secondary hot water system load generally indicated at 180, a bypass line 192, and a hydraulic interface 10. Beginning with the primary system, primary hot water pump no. 1, designated by the numeral 196, pumps water through an inlet pipe 204 into boiler no. 1, designated by the numeral 152. Similarly, primary hot water pump no. 2, designated by the numeral 198, pumps water through inlet pipe 206 into boiler no. 2, designated by the numeral 154. In a system having two boilers, it is typical for each boiler to be of the same capacity, and their primary pumps would similarly be of the same capacity. In FIG. 8, the first primary hot water pump 196 is a constant speed pump having a flow capacity of $Q_1$. The second primary hot water pump 198 is also a constant speed pump and has a similar flow capacity $Q_1$.

After being heated, hot water exits the first boiler 152 through outlet pipe 156. In a similar fashion hot water exits the second boiler 154 through outlet pipe 158. The direction of the water flow is given by arrows in the diagram of FIG. 8. Outlet pipes 156 and 158 join together to form an outlet header 160, through which the primary hot water supply flows. If only one of the boilers is operating, the flow rate through outlet header 160 is equal to $Q_1$. If both boilers are operating simultaneously, then the flow rate through outlet header 160 is equal to $2Q_1$.

It will be understood that primary pumps 196 and 198 could be located on the outlet side of boilers 152 and 154, rather than on the inlet side of those same boilers (as shown in FIG. 8). If the primary pumps are located on the outlet side of the boilers, the overall hot water system operation is not affected in any substantial way.

At this point, the supply primary hot water enters the suction manifold 176, which will be described in greater detail below. Generally speaking, most of the supply primary hot water will enter the secondary hot water pump suction pipes 166 and 168. Suction pipe 166 feeds into the first secondary hot water pump 162, and suction pipe 168 feeds into the second secondary hot water pump 164. Secondary hot water pumps 162 and 164 are variable speed pumps, each having a maximum flow capacity of $Q_1$ when running at their maximum speed. Secondary hot water pumps 162 and 164 are also capable of producing a sufficient discharge pressure head to overcome the friction losses of the piping of the secondary hot water system, and the heating coil losses of the system load 180.

The first secondary hot water pump 162 discharges water through its discharge pipe 170, into the secondary hot water discharge header 210, and finally into a pipe 174 which is the secondary hot water supply. In a similar fashion, the second secondary hot water pump 164 discharges water through discharge pipe 172, into the secondary hot water discharge header 210, and into the secondary hot water supply 174.

The secondary hot water supply is directed into the system load 180, which consists, in the hydraulic circuit of FIG. 8, of a pair of valves and heating coils. Some of the secondary hot water supply flows through a first valve 182 and into a first heating coil 184. The remaining secondary hot water supply flows through a second valve 186 and through a second heating coil 188. After flowing through the heating coils, the hot water has now been lowered in temperature to approximately 1.80° F. (82° C.). At this point, the hot water is returned through a common pipe 190 toward the suction manifold 176.

Secondary hot water return 190 directs water through hydraulic interface 10 and into the suction manifold 176. Temporarily ignoring the bypass line 192, the returned water from the secondary hot water system then flows into a primary hot water return pipe 194, which further directs the water into individual suction pipes 200 and 202. Suction pipe 200 returns water to the first primary hot water pump 196, and suction pipe 202 returns water to the second primary hot water pump 198.

The loop has now been completed and the hot water will hence be heated within the boilers 152 and 154 up to a temperature level of around 210° F. (99° C.). The above description assumed that there was no water flowing through the bypass line 192, a situation which would only rarely occur. If one boiler was operating at a flow of $Q_1$, and the system and heating load was such that one of the secondary hot water pumps was running at its maximum speed and flow capacity $Q_1$, than the flow through bypass line 192, designated by the letter "G", would be zero. In other words, the supply primary hot water flow running through pipe 160 would be equal to $Q_1$, the supply secondary hot water running through pipe 174 would also equal $Q_1$, the return secondary hot water running through pipe 190 would be $Q_1$, and the return primary hot water running through pipe 194 would also equal $Q_1$.

Since the secondary hot water pumps 162 and 164 are variable speed pumps, they can run at speeds other than their maximum speed, thereby each producing a flow capacity less than $Q_1$. In situations where a secondary hot water pump 162 or 164 is running other than at its maximum speed, its output will be a flow rate $Q_2$, which is less than $Q_1$. In that situation, the bypass flow, designated by the letter G, would be equal to $Q_1—Q_2$, and the direction of the flow through bypass line 192 would be from top to bottom in FIG. 8. This is the normal case, for the variable speed secondary hot water pumps 162 and 164 are designed to operate in just this manner.

On the other hand, if only one of the boilers 152 or 154 is operating, thereby producing a supply primary hot water flow $Q_1$, and if both secondary hot water pumps 162 and 164 are operating at a combined flow of $Q_3$ (which is greater than $Q_1$) at the secondary hot water supply pipe 174, then the direction of the bypass line flow G would be from bottom toward the top in FIG. 8. In other words, some of the secondary hot water would be recirculating, rather than some of the primary hot water being recirculated as in the previous example. This, however, is not the normal operating mode of a hot water system, for it is inefficient to run two secondary hot water pumps at a reduced speed and flow rate as compared to running just one of those secondary hot water pumps at full speed and flow rate.

Hydraulic interface 10 causes a thorough blending of the bypass water in bypass line 192 with the return secondary hot water from return line 190. Since the water exiting hydraulic interface 10 is so thoroughly blended, the temperature profile is substantially uniform in the return primary hot water portion 194 of suction manifold 176. This uniform temperature profile ensures that each boiler 152 and 154 will receive intake water at the same temperature, thereby eliminating the possibility of a temperature imbalance condition.

As will be understood, the principles of the present invention apply equally as well to hot water systems as to chilled water systems. This is true whether the secondary hot water pumps are constant speed pumps or variable speed pumps. A more efficient hot water system would include variable speed secondary pumps. However, the hydraulic interface 10 would work equally well in a hot water system regardless of the type of secondary hot water pumps.

In a presently available hot water system, the temperature profile of FIG. 2A would be shaped in the opposite manner. In other words, the warmer temperature would be located along the bottom portion of the suction manifold pipe 58 because the primary hot water would tend to be directed toward the bottom of that suction manifold. At the same time, the cooler temperature would tend to be directed toward the top portion of suction manifold pipe 58, because the return secondary hot water would be forced to remain in the upper portions of that suction manifold. Once the hydraulic interface 10 of the present invention is installed in such a hot water system, then the temperature profile of that hot water system at its suction manifold 176 would look very similar to FIG. 4A in shape. Of course, the absolute temperature would be at a much larger magnitude than in the chilled water case given in FIG. 4A.

The foregoing description of preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A hydraulic interface, comprising a hollow cylinder with a cylindrical wall which has a first open inlet end and a second closed end, said cylindrical wall having a large opening formed therein comprising a bidirectional flow opening, and said cylindrical wall having a plurality of smaller openings formed therein comprising outlet openings, wherein said first open end of said cylindrical wall is sufficiently large to allow a first fluid to enter said hollow cylinder without significant pressure loss, said inlet opening in said cylindrical wall being sufficiently large to allow a second fluid to enter said hollow cylinder without significant pressure loss, and said plurality of smaller outlet openings in said cylindrical wall being sufficiently small to cause said first fluid and said second fluid to be substantially blended together within said cylinder before the first and second fluids can exit said hollow cylinder through said plurality of outlet openings.

2. A hydraulic interface as recited in claim 1, wherein said cylindrical wall is constructed of schedule 40 black carbon steel, and wherein said hydraulic interface can be used in both chilled water system and hot water system applications.

3. A hydraulic interface as recited in claim 3, wherein said first and second fluids are substantially blended together under varying flow, pressure, and temperature conditions, without significant change in performance of said hydraulic interface.

4. A hydraulic interface as recited in claim 3, wherein said first and second fluids are substantially blended without the use of any moving parts within said hydraulic interface.

5. A hydraulic interface, comprising a hollow cylinder having a cylindrical wall and having a first open end and a second closed end, said cylindrical wall having an opening formed therein, said cylindrical wall having a plurality of perforations formed therein, said perforations being smaller than said opening, means for causing a first fluid to enter said first open end of the hollow cylinder and a second fluid to enter said opening in the cylindrical wall wherein said first and second fluids are substantially blended together within said hollow cylinder before exiting said hollow cylinder through said plurality of perforations in the cylindrical wall.

6. The hydraulic interface as recited in claim 5, whereby when fluid enters the cylinder only via said first open end, said fluid will exit the hollow cylinder at both said opening in the cylindrical wall and at said plurality of perforations in the cylindrical wall.

7. A hydraulic interface as recited in claim 5, wherein said cylindrical wall is constructed of schedule 40 black carbon steel, and wherein said hydraulic interface can be used in both chilled water system and hot water system applications.

8. A hydraulic interface as recited in claim 5, wherein said first open end of said hollow cylinder is sufficiently large to allow said first flow to enter the hollow cylinder without significant pressure loss, and said opening in said cylindrical wall is sufficiently large to allow said second fluid to enter the hollow cylinder without significant pressure loss.

9. A hydraulic interface as recited in claim 8, wherein said first and second fluids are substantially blended together under varying flow, pressure, and temperature conditions, without significant change in performance of said hydraulic interface.

10. A hydraulic interface as recited in claim 9, wherein said first and second fluids are substantially blended without the use of any moving parts within said hydraulic interface.

* * * * *

UNITED STATES PATENT AND TRADEMARK OFFICE

CERTIFICATE OF CORRECTION

PATENT NO. : 5,316,384

DATED : May 31, 1994

INVENTOR(S) : Anthony B. Corso

It is certified that error appears in the above-indentified patent and that said Letters Patent is hereby corrected as shown below:

Column 14, line 10, (claim 3), after the word "claim" the number "3", should read --1--

Column 14, line 43, (claim 8), "flow", should read --fluid--

Signed and Sealed this

Sixteenth Day of August, 1994

*Attest:*

Bruce Lehman

BRUCE LEHMAN

*Attesting Officer*

*Commissioner of Patents and Trademarks*